US011015318B2

(12) United States Patent
Rupp et al.

(10) Patent No.: US 11,015,318 B2
(45) **Date of Patent: *May 25, 2021**

(54) HYBRID LOAD BUCKET ASSEMBLY

(71) Applicant: Deere & Company, Moline, IL (US)

(72) Inventors: Sebastian Rupp, Eppingen (DE); Carlos Vargas, Monterrey (MX); Joerg Jens Hoefle, Seeheim-Jugenheim (DE); Ignacio Alonso Martinez, Ramos Arizpe (MX); Sankaran Subramaniam, Bettendorf, IA (US); Steffen Fischer, Karlsruhe (DE); Jonathan J. Nelson, Davenport, IA (US)

(73) Assignee: Deere & Company, Moline, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/863,211

(22) Filed: Apr. 30, 2020

(65) Prior Publication Data

US 2020/0256033 A1 Aug. 13, 2020

Related U.S. Application Data

(63) Continuation of application No. 15/805,476, filed on Nov. 7, 2017, now Pat. No. 10,662,610.

(51) Int. Cl.

| | |
|---|---|
| ***E02F 3/40*** | (2006.01) |
| *E02F 3/30* | (2006.01) |
| *E02F 3/34* | (2006.01) |

(52) U.S. Cl.

CPC ..... *E02F 3/40* (2013.01); *E02F 3/308* (2013.01); *E02F 3/3417* (2013.01)

(58) Field of Classification Search

CPC ..... E02F 3/40; E02F 3/308; E02F 3/3417

See application file for complete search history.

(56) References Cited

U.S. PATENT DOCUMENTS 2,228,447 A * 1/1941 Evelev ..... A01D 45/26 171/44
3,807,587 A * 4/1974 Maurer ..... E02F 3/401 37/444

(Continued)

FOREIGN PATENT DOCUMENTS

DE 202010002040 U1 5/2010
WO 2015196251 A1 12/2015

OTHER PUBLICATIONS

Extended European Search Report for Application No. 18204521.1, dated Mar. 6, 2019.

(Continued)

*Primary Examiner* — Jamie L McGowan
(74) *Attorney, Agent, or Firm* — Tucker Ellis LLP; Michael G. Craig; Heather M. Barnes

(57) ABSTRACT

A hybrid bucket assembly for a work vehicle having movable loader arms includes a structural skeleton having a frame, one or more support struts mounted to the frame, and one or more brackets coupled to the support struts configured to interface with a carrier at distal ends of the loader arms. A bucket shell is mounted to the skeleton that defines a carry volume for materials. Force loading on the bucket shell is carried by the skeleton through the struts.

18 Claims, 10 Drawing Sheets

(56) References Cited

U.S. PATENT DOCUMENTS

| | | | | |
|---|---|---|---|---|
| 4,086,712 | A * | 5/1978 | McReynolds | E02F 3/401 37/444 |
| 5,267,402 | A * | 12/1993 | Russell | E02F 3/40 37/379 |
| 6,408,551 | B1 * | 6/2002 | Pettersson | B07B 1/12 37/409 |
| 7,484,321 | B1 * | 2/2009 | Stafne, Sr. | E02F 3/401 37/227 |
| 7,718,724 | B2 | 5/2010 | DeCristofaro et al. | |
| 8,827,627 | B2 | 9/2014 | Landry et al. | |
| 10,024,027 | B2 * | 7/2018 | Worth | E02F 3/40 |
| 2005/0193602 | A1 * | 9/2005 | Osgood | E02F 3/40 37/411 |
| 2005/0254935 | A1 | 11/2005 | Downing | |
| 2018/0087246 | A1 * | 3/2018 | Pratt | E02F 9/2883 |

OTHER PUBLICATIONS

Construction Equipment Guide, Composite Cutting Edge From Nye Designed for Excavator, Loader Buckets, ConstructionEquipmentGuide.com, National Edition, Dec. 16, 2009.

Vabo Composites: Consortium Wins Prestigious Innovation Award, 2017.

NLR Netherlands Aerospace Center news article: Lightweight Bucket for Heavy Construction Work, nlr.org/news, Mar. 2015.

NLR Netherlands Aerospace Center news article: Fokker and NLR Open High-Tech Pilot Plant for Composite Components, nlr.org/news, Mar. 2015.

Delta HL, Light Material Loader Buckets, Delta HL, spol. s.r.o. 2016.

Delta HL, Other Loader Buckets, Delta HL, spol s.r.o. 2016.

* cited by examiner

HYBRID LOAD BUCKET ASSEMBLY

CROSS-REFERENCE TO RELATED APPLICATION(S)

This application is a continuation of U.S. Ser. No. 15/805,476, titled HYBRID LOAD BUCKET ASSEMBLY, filed Nov. 7, 2017, which is incorporated herein by reference.

FIELD OF THE DISCLOSURE

This disclosure relates to work vehicles and load buckets in which the work vehicles carry material.

BACKGROUND OF THE DISCLOSURE

In the agriculture, construction and forestry industries, various work machines, such as loaders, may be utilized in lifting and moving various materials. In certain examples, a loader may include a bucket pivotally coupled by a boom or loader arms to the vehicle chassis. One or more hydraulic cylinders move the boom or loader arms and/or the bucket to move the bucket between positions relative to the chassis to lift and move materials.

Various factors are considered when designing or selecting the loader and bucket arrangement used, for example, the durability and wear resistance of the bucket, especially at the bottom leading edge, and the volume of material the bucket can carry. These factors typical indicate that the loader arms and bucket be made of heavy steel plate construction to handle large volumes of material and the corresponding weight and other forces associated with loading and carrying the heavy material. This also requires a robust hydraulic system with correspondingly large-capacity pumps, accumulators, valves and cylinders. Further, wear or damage to the bucket may also require replacement or vehicle downtime to repair the heavy-duty components.

SUMMARY OF THE DISCLOSURE

The disclosure provides a hybrid load bucket assembly in which a skeleton framework that mounts to a loader arm carrier supports a bucket shell. In some cases, the bucket shell may be of lightweight construction and removably attached to the skeleton.

In one aspect, the disclosure provides a hybrid bucket assembly for a work vehicle having movable loader arms includes a structural skeleton having a frame, one or more support struts mounted to the frame, and one or more brackets coupled to the support struts configured to interface with a carrier at distal ends of the loader arms. A bucket shell is mounted to the skeleton that defines a carry volume for materials. Force loading on the bucket shell is carried by the skeleton through the struts.

In another aspect, the disclosure provides a work vehicle having a chassis, loader arms movably mounted to the chassis, and a carrier mounted to distal ends of the loader arms. A hybrid bucket assembly includes a structural skeleton having a frame, one or more support struts mounted to the frame, and one or more brackets coupled to the support struts and mountable to the carrier. A bucket shell is mounted to the skeleton that defines a carry volume for materials. Force loading on the bucket shell is carried by the skeleton through the struts.

The details of one or more embodiments are set forth in the accompanying drawings and the description below.

Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
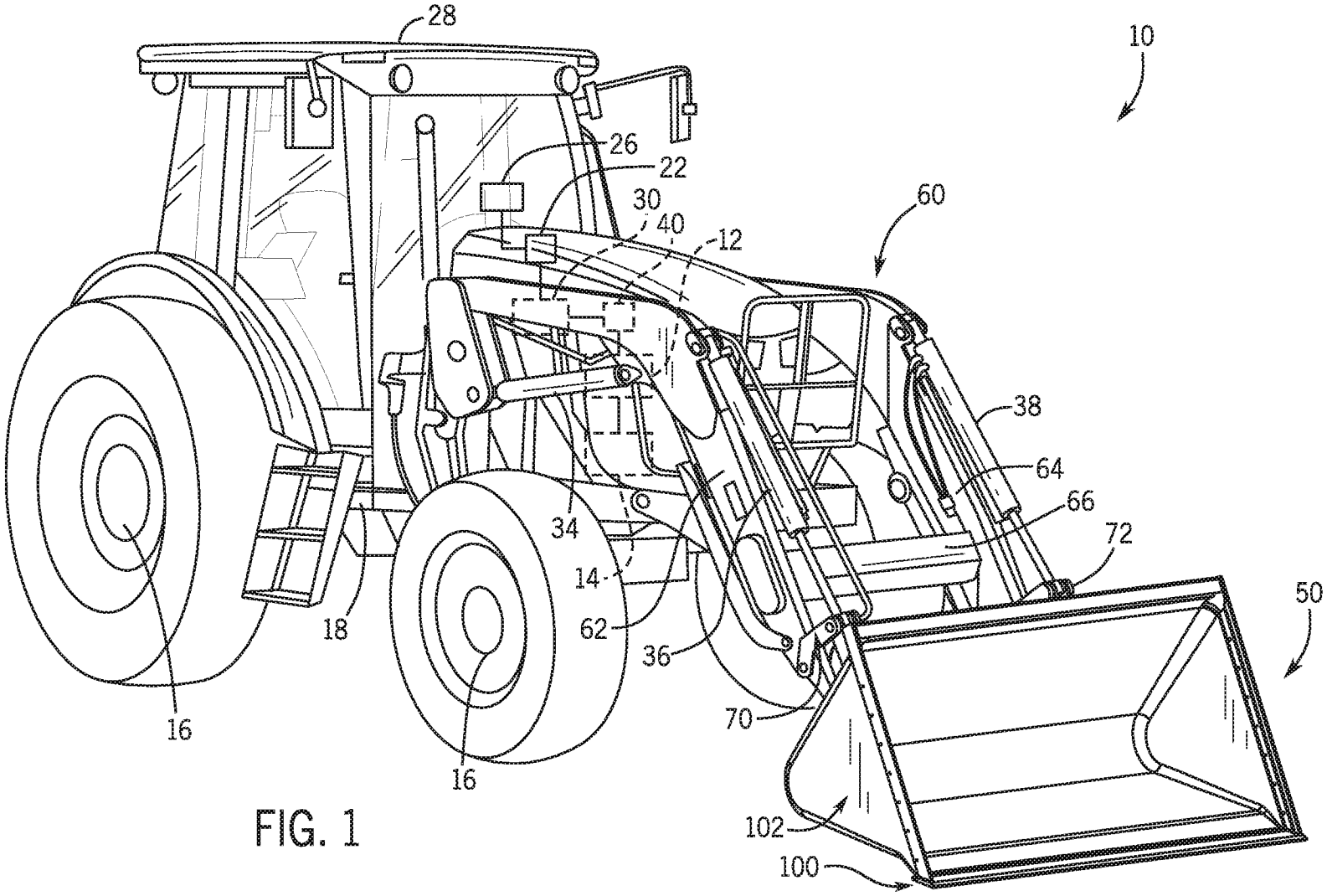
FIG. 1 is a perspective view of an example work vehicle in the form of an agricultural loader in which the disclosed hybrid load bucket assembly may be used.

The following describes one or more example embodiments of the disclosed hybrid load bucket assembly, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Conventional load buckets for use in various construction and agricultural applications to haul materials (e.g., dirt, sand, aggregate and so on) are typically cast or fabricated of heavy-duty construction using high-strength materials (e.g., steel). The heavy-duty construction affords conventional load buckets the ability to undergo extreme loading and treatment during use as well as provide for high load volumes (e.g., 1, 2 or more cubic yards). In addition to the material itself, the weight of the heavy-duty bucket most be accommodated by the host machine, and specifically by its hydraulic system, to ensure that the machine performs as expected, that is will raise and lower the load bucket at the rate and range of motion desired. Further, as heavy and rugged as they are, encountering sufficient loading, abrasion or other forces can cause damage to conventional load buckets. The load buckets may yield (i.e., crack) due to impact or stress concentrations, or they may experience wear (e.g., at the lower leading or "cutting" edge of the bucket)

that may impact the performance of the machine. Damage or worn load buckets may need to be replaced or repaired at significant expense or operational downtime of the machine.

This disclosure provides an alternative to the conventional load bucket through the use of a hybrid assembly of a skeletal framework that supports a bucket shell, which defines the load volume for containing the material. In certain embodiments, this permits the bucket shell to be a light-duty construction, such as made with any suitable thin-walled or lightweight materials. For example, the disclosed hybrid load bucket assembly ("HLBA") may have a bucket shell formed of a resin material (e.g., a suitable thermo- or other plastic, such as an ABS, polypropylene, polyethylene, or high impact polystyrene material). The bucket shell could also be a composite material, such as a reinforced resin material (e.g., glass reinforced polypropylene). Such a bucket shell may be a homogeneous or composite, thin-walled (relative to conventional steel load buckets) resin formed using any suitable molding technique (e.g., rotational molding, injection molding, resin transfer molding, and so on). In this way, the disclosed HLBA may have both lightweight and low-cost attributes. It should be noted that the bucket shell may be formed with non-resin materials, such as various metals, in which case the bucket shell may also have a thin-walled, lightweight construction. Various advanced, technical materials (e.g., magnesium alloys, carbon fiber, Kevlar® and the like) may also be used. Further, it is also possible to utilize a bucket shell that has a heavy-duty construction, such as being formed of various steel materials (e.g., stainless steel or thick-walled, high-strength and high-wear steel, as in conventional load buckets).

In any case, the bucket shell is supported and coupled to the machine by the skeletal framework. In the case of light-duty constructions the bucket shell may be primarily supported and reinforced by the framework so that the loading realized by the bucket shell during use is carried by the framework to the machine. Further, the framework may also provide for perimetric support around the periphery of the bucket shell as well as at the leading (or cutting) edge of the HLBA, which tends to maintain the shape of the bucket shell (and thereby the load volume) as well as provide a leading edge that is more resistant to wear. The HLBA may also be configured so that the bucket shell is recessed within the framework to further reduce leading edge wear on the bucket shell.

In certain embodiments, the framework is a structural skeleton, in some cases an exoskeleton, that includes a frame and support struts. The frame may form the perimeter support of the bucket shell, for example, having a rectangular configuration sized and shaped to correspond to the top, bottom and sides of the bucket shell. The support struts may be various structural members (e.g., solid or hollow tubular members) of straight or bent configuration that are sized, shaped and positioned to support the bucket shell. For example, the support struts may include various bent or angled struts shaped to conform (loosely or closely) to a back surface of the bucket shell so that some or all the length of these struts contact, and thus back, the bucket shell. The struts may be located, oriented and configured to back the bucket shell along areas of known or expected relatively high load concentrations, for example, in regions that are within the outer one-quarter to one-third of the lateral dimension (i.e., side-to-side dimension or width) of the HLBA. Various cross-struts may rigidly connect the bent bucket shell-conforming struts to stabilize and rigidify the framework. The network of struts and the frame may be assembled in any known way providing for a rigid, structural framework, including mechanical fasteners, adhesives, welding, brazing and so on.

In various embodiments, the HLBA may be configured so that the bucket shell is removably mounted to the skeletal framework. For example, various mechanical fasteners, adhesives and the like may be used to secure the bucket shell to the frame and/or support struts. The bucket shell and/or the framework may also be configured with features that aid in mounting and dismounting such a removable bucket shell. For example, the bucket shell may have a mounting flange along some of or all its periphery through which the mechanical fasteners may extend when mounting to the framework. In some embodiments, the bucket shell may have an upper flange that is formed to fit over a top lateral member of the frame in hanger-like fashion. Irrespective of the configurational details, removably mounting the bucket shell allows for rapid (and as mentioned above, low-cost) replacement of the bucket shell, and thus repair of the HLBA, without necessarily separating the HLBA from the machine (i.e., by disconnecting it from the carrier to dismount it from the loader arms).

Figure 2:
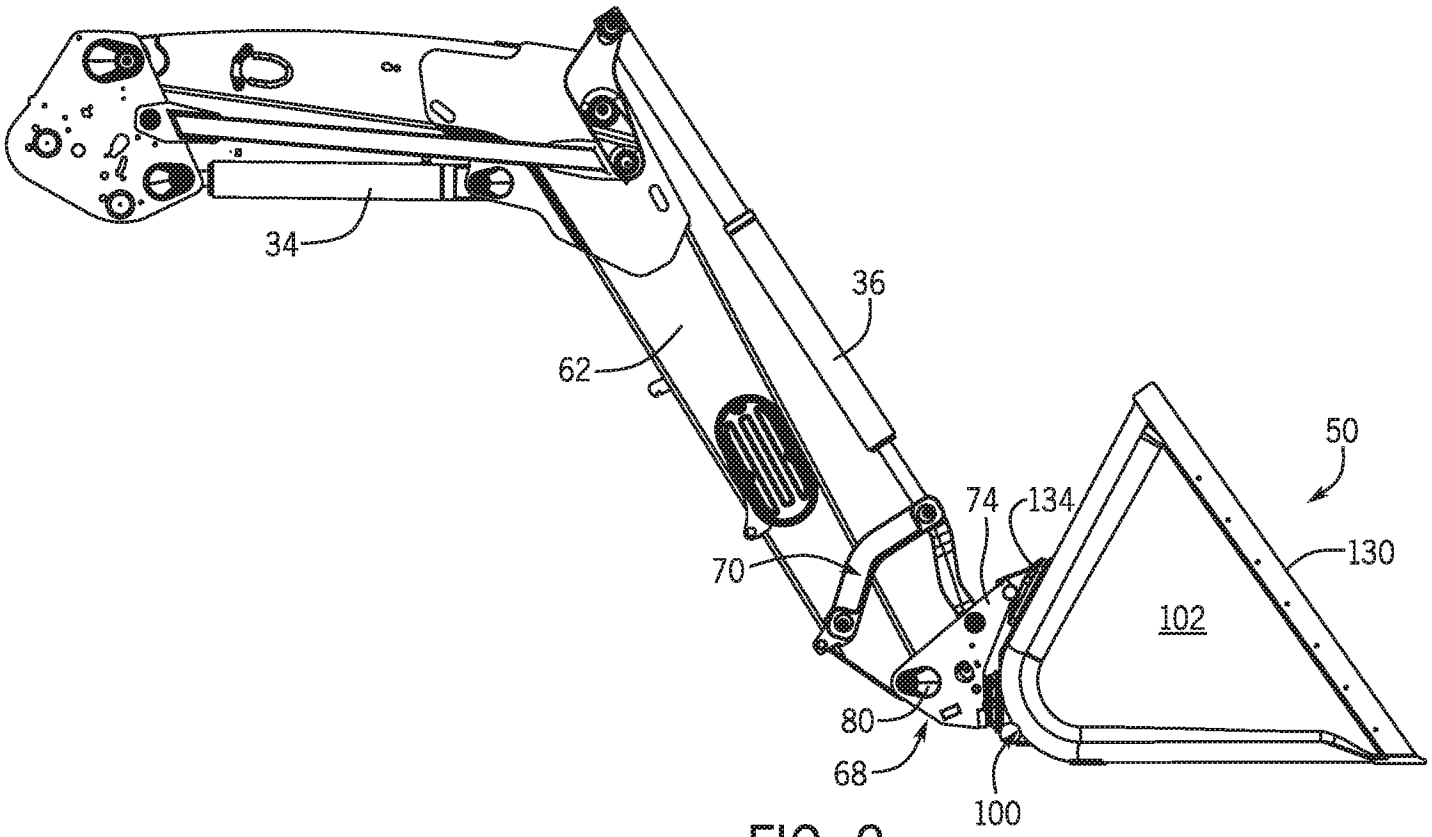
FIG. 2 is a side view of an example loader arm assembly with the hybrid load bucket assembly as shown in FIG. 1.
Figure 3:
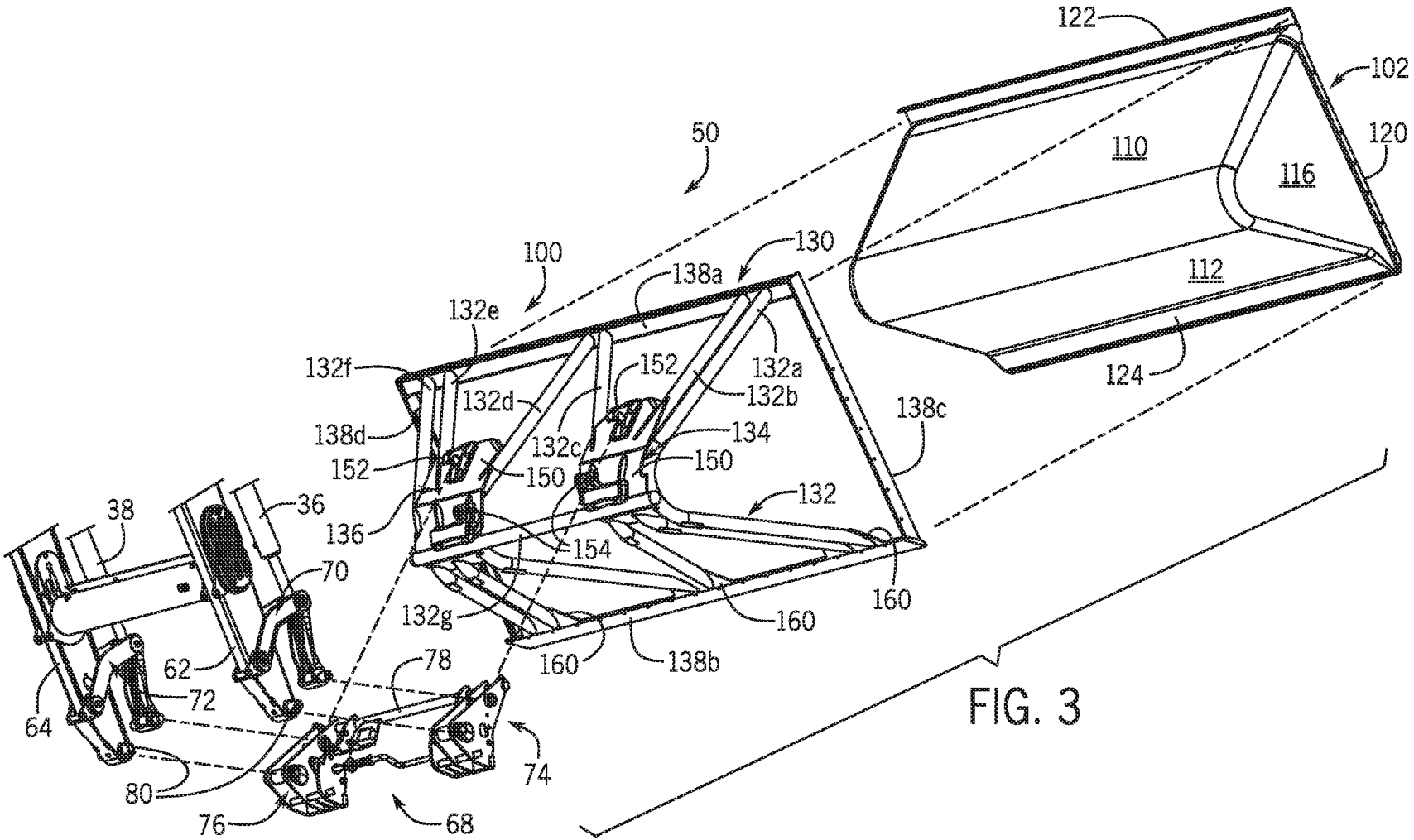
FIG. 3 is a partial exploded rear perspective view thereof.

The following describes one or more example implementations of the disclosed HLBA. The HLBA may be utilized with various machines or work vehicles, including loaders and other machines for lifting and moving various materials in the agricultural and construction industries. Referring to FIGS. 1 and 2, in some embodiments, the HLBA may be used with an agricultural loader 10. It will be understood that the configuration of the loader 10 is presented as an example only. In this regard, the disclosed HLBA may be implemented as a front loader removably coupled to a work vehicle, such as a tractor. Other work vehicles, such as dedicated wheel loaders used in the construction industry, may benefit from the disclosed HLBA as well.

Generally, the loader 10 includes a source of propulsion, such as an engine 12 that supplies power to a transmission 14. In one example, the engine 12 is an internal combustion engine, such as a diesel engine, that is controlled by an engine control module. The transmission 14 transfers power from the engine 12 to a suitable driveline coupled to one or more driven wheels 16 of the loader 10 to enable the loader 10 to move. The engine 12, the transmission 14 and the rest of the driveline are supported by a vehicle chassis 18, which is supported off the ground by the wheels 16. As is known to one skilled in the art, the transmission 14 can include a suitable gear transmission, which can be operated in a variety of ranges containing one or more gears, including, but not limited to a park range, a neutral range, a reverse range, a drive range, a low range, a high range, etc. The transmission 14 may be controlled by a transmission control module, which is, along with the engine control module, in communication with a master controller 22 (or group of controllers).

The controller 22 may control various aspects of the operation of the loader 10 and may be configured as a computing device with associated processor devices and memory architectures, as a hard-wired computing circuit (or circuits), as a programmable circuit, as a hydraulic, electrical or electro-hydraulic controller, or otherwise. As such, the controller 22 may be configured to execute various computational and control functionality with respect to the loader 10 (or other machinery). In some embodiments, the controller 22 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 22 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 22 may be in electronic, hydraulic, mechanical, or other communication with various other systems or devices of the loader 10 (or other machinery). For example, the controller 22 may be in electronic or hydraulic communication with various actuators, sensors, and other devices within (or outside of) the loader 10, including various devices associated with a hydraulic system. The controller 22 may communicate with other systems or devices (including other controllers) in various known ways, including via a CAN bus (not shown) of the loader 10, via wireless or hydraulic communication means, or otherwise. An example location for the controller 22 is depicted in FIG. 1. It will be understood, however, that other locations are possible including other locations on the loader 10, or various remote locations. In some embodiments, the controller 22 may be configured to receive input commands and to interface with an operator via a human-machine interface 26, which may be disposed inside a cab 28 of the loader 10 for easy access by the operator. The human-machine interface 26 may be configured in a variety of ways and may include one or more joysticks, various switches or levers, one or more buttons, a touchscreen interface that may be overlaid on a display, a keyboard, a speaker, a microphone associated with a speech recognition system, or various other human-machine interface devices.

The loader 10 also has a hydraulic system that includes one or more pumps and accumulators (designated generally by reference number 30), which may be driven by the engine 12 of the loader 10. Flow from the pumps 30 may be routed through various control valves and various conduits (e.g., flexible hoses) to drive various hydraulic cylinders, such as hydraulic cylinders 34, 36, 38, shown in FIG. 1. Flow from the pumps (and accumulators) 30 may also power various other components of the loader 10. The flow from the pumps 30 may be controlled in various ways (e.g., through control of various electro-hydraulic control valves 40) to cause movement of the hydraulic cylinders 34, 36, 38, and thus, a HLBA 50 relative to the loader 10. In this way, for example, movement of the HLBA 50 between various positions relative to the chassis 18 of the loader 10 may be implemented by various control signals to the pumps 30, control valves 40, and so on.

In the embodiment depicted, the HLBA 50 is pivotally mounted to a boom assembly 60, which in this example, includes a first loader arm 62 and a second loader arm 64, which are interconnected via a cross-beam 66 to operate in parallel. The loader arms 62, 64 are each coupled to the chassis 18, directly or via another frame portion of the loader 10, at one end, and are coupled at an opposite end to the HLBA 50 via a carrier 68, which is pivoted via first and second (left and right) pivot linkages 70, 72. In the illustrated example, the carrier 68 comprises first and second (left and right) couplers 74, 76, connected by a cross-rod 78, that mount to the distal ends of the respective loader arms 62, 64 via coupling pins 80. Additional pins pivotally couple the pivot linkages 70, 72 between the loader arms 62, 64 and the respective first and second couplers 74, 76. The pivot linkages 70, 72 enable pivotal movement of the HLBA 50 upon actuation of the hydraulic cylinders 36, 38.

The hydraulic cylinders may be actuated to raise and lower the boom assembly 60 relative to the loader 10. In the illustrated example, the boom assembly 60 includes two hydraulic cylinders, namely the hydraulic cylinder 34 coupled between the chassis 18 and the first loader arm 62 and a corresponding cylinder on the opposite side of the loader (not shown) coupled between the chassis 18 and the second loader arm 64. It should be noted that the loader 10 may have any number of hydraulic cylinders, such as one, three, etc. Each of the hydraulic cylinders 34 includes an end coupled to the chassis 18 (e.g., via a coupling pin) and an end mounted to the respective one of the first loader arm 62 and the second loader arm 64 (e.g., via another pin). Upon activation of the hydraulic cylinders 34, the boom assembly 60 may be moved between various positions to elevate the boom assembly 60, and thus the HLBA 50, relative to the chassis 18 of the loader 10.

One or more hydraulic cylinders 36 are mounted to the first loader arm 62 and the first pivot linkage 70, and one or more hydraulic cylinders 38 are mounted to the second loader arm 64 and the second pivot linkage 72. In the illustrated example, the loader 10 includes a single hydraulic cylinder 36, 38 associated with a respective one of the first loader arm 62 and the second loader arm 64, respectively. Each of the hydraulic cylinders 36, 38 includes an end mounted to the respective one of the first loader arm 62 and the second loader arm 64 (via another pin) and an end mounted to the respective one of the first pivot linkage 70 and the second pivot linkage 72 (via another pin). Upon activation of the hydraulic cylinders 36, 38, the HLBA 50 may be moved between various positions, namely to pivot the carrier 68, and thereby the HLBA 50, relative to the boom assembly 60.

Thus, in the embodiment depicted, the HLBA 50 is pivotable about the carrier 68 of the boom assembly 60 by the hydraulic cylinders 36, 38. As noted, in some embodiments, a different number or configuration of hydraulic cylinders or other actuators may be used. Thus, it will be understood that the configuration of the hydraulic system and the boom assembly 60 is presented as an example only. In this regard, in other contexts, a hoist boom (e.g. the boom assembly 60) may be generally viewed as a boom that is pivotally attached to a vehicle frame, and that is also pivotally attached to an end effector (e.g., the HLBA 50). Similarly, the carrier 68 (e.g., the couplers 74, 76) may be generally viewed as a component effecting pivotal attachment of a bucket (e.g. the HLBA 50) to a vehicle frame. In this light, a tilt actuator (e.g., the hydraulic cylinders 36, 38) may be generally viewed as an actuator for pivoting a receptacle with respect to a hoist boom, and the hoist actuator (e.g. the hydraulic cylinders 34) may be generally viewed as an actuator for pivoting a hoist boom with respect to a vehicle frame.

In certain applications, sensors (e.g., pressure, flow or other sensors) may be provided to observe various conditions associated with the loader 10. For example, the sensors may include one or more pressure sensors that observe a pressure within the hydraulic circuit, such as a pressure associated with at least one of the pumps 30, the control valves 40 and/or one or more hydraulic cylinders 34, 36, 38 to observe a pressure within the hydraulic cylinders and generate sensor signals based thereon. In some cases, various sensors may be disposed on or near the carrier 68 and/or the HLBA 50. For example, sensors (e.g. inertial measurement sensors) may be coupled on or near the HLBA 50 to observe or measure parameters including the acceleration of the boom assembly 60 and/or the HLBA 50 and generate sensor signals, which may indicate if the boom assembly 60 and/or the HLBA 50 is accelerating or decelerating. In some embodiments, various sensors (e.g., angular position sensors) may be configured to detect the angular orientation of the HLBA 50 relative to the boom assembly 60, or to detect the angular orientation of the boom assembly relative to the chassis 18, and various other indicators of the current orientation or position of the HLBA 50. For example, rotary angular position sensors may be used or linear position or displacement sensors may be used to determine the length of the hydraulic cylinders 34, 36, 38 relative to the boom assembly 60.

The HLBA 50 generally defines a receptacle for carrying various materials, such as dirt, rocks, wet dirt, sand, hay, etc. In one example, the HLBA 50 may receive about two cubic yards of material to over about five cubic yards of material. The HLBA 50 is movable upon actuation of the hydraulic cylinders 36, 38 between a level position, a roll-back position and a dump position, along with various positions in between. In the level position, the HLBA 50 can receive various materials. In the roll-back position, the HLBA 50 is pivoted upward relative to the earth's surface or ground by the actuation of the hydraulic cylinders 36, 38 such that the HLBA 50 may be loaded with and retain the various materials. In the dump position, the HLBA 50 is pivoted downward relative to the earth's surface or ground by the actuation of the hydraulic cylinders 36, 38 such that the various materials may fall from the HLBA 50 to substantially empty the HLBA 50.

Referring also to FIGS. 3-6B, the example HLBA 50 will now be detailed. The HLBA 50 includes a structural skeleton 100 supporting a bucket shell 102. In the illustrated example, the skeleton 100 is an exoskeleton in that it external to the bucket shell 102. The exoskeleton construction facilitates removal and replacement of the bucket shell 102 should it be damaged. However, in other contexts, the skeleton may be internal to the bucket shell, for example, with the bucket shell being constructed or formed (e.g., via an insert-molding operation) about the skeleton in which molecular bonding or mechanical fasteners are used to connect, and transfer loads from, the bucket shell to the skeleton. As noted above, the bucket shell 102 may be, and is in the illustrated example, of light-duty construction such that the skeleton 100 supports the bucket shell and provides the primary load-handling component of the HLBA 50.

The bucket shell 102 has a relatively thin-walled construction (e.g., less than ¼ inch) of relatively lightweight material, when compared to the plate or cast steel constructions of conventional load buckets that may have a wall-thickness of 10-20 mm (approximately ½-¾ inches). The bucket shell 102, and indeed the HLBA 50 overall, thus may be significantly lighter than conventional buckets of comparable size and volume. The example bucket shell 102 illustrated is a composite (e.g., glass reinforced polypropylene) formed of a base resin material (e.g., a suitable thermo- or other plastic such as an ABS, polypropylene, polyethylene, or high impact polystyrene material) that is impregnated with a reinforcing material (e.g., a suitable fibrous material such as glass or carbon fiber). The walls of the bucket shell 102 are approximately 6 mm thick, giving the bucket shell 102 a weight of approximately 78 kg (approximately 170 lbs.). A bucket shell 102 of such composite construction may be formed using any suitable molding technique (e.g., rotational molding, injection molding, resin transfer molding, etc.). The bucket shell 102 may also be formed with non-resin materials, such as various metals, and still have a relatively thin-walled, lightweight construction. Further, the bucket shell 102 has a single-wall construction being a single layer of composite material throughout the bucket shell 102. However, various multi-wall configurations are envisioned. For example, the bucket shell may be a double-walled construction (i.e., two walls spaced apart in cross section). Further, the bucket shell 102 may include various internal or external reinforcing members, such as integrally formed (e.g., molded) walls, ribs or lattice structures that aid in the rigidity of the bucket shell 102. In the case of a double-walled bucket shell, the reinforcing members may be internal, extending between two outer walls forming the exterior of the bucket shell.

Figure 9:
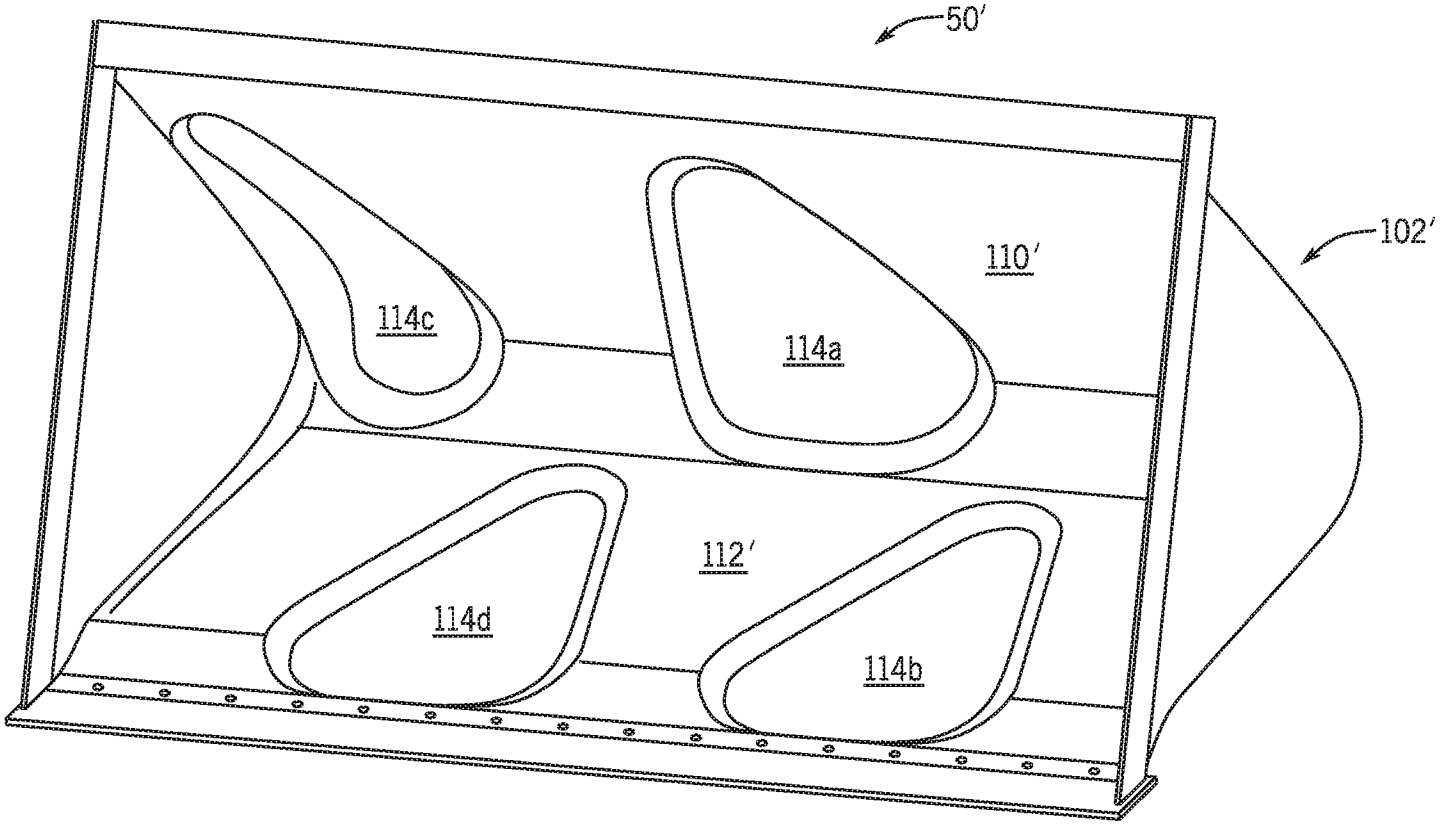
FIG. 9 is a front perspective view of an alternative example hybrid load bucket assembly in which the bucket shell has recessed material cavities.

The bucket shell 102 is formed in a configuration suitable to carry loads of material (e.g., gravel, dirt, etc.) similar to conventional load buckets. Specifically, the bucket shell 102 has lateral upper and lower walls 110, 112 continuously joined by an angled or curved section in the back and generally forming a forwardly tipped "V" shape. The walls 110, 112 are generally flat and straight (other than at the rounded area). In some embodiments, such as shown in FIG. 9, the walls (lateral walls 110', 112' of bucket shell 102') may be formed with load cavities or recesses 114 (e.g., recesses 114*a*-*d*) that increase the carry volume of the HLBA (HLBA 50' in the FIG. 9 embodiment). Side walls 116, 118 cap the volume defined by the walls 110, 112. The side walls may also have carry volume-enhancing recesses (although not shown in the FIG. 9 embodiment).

Figure 4A:
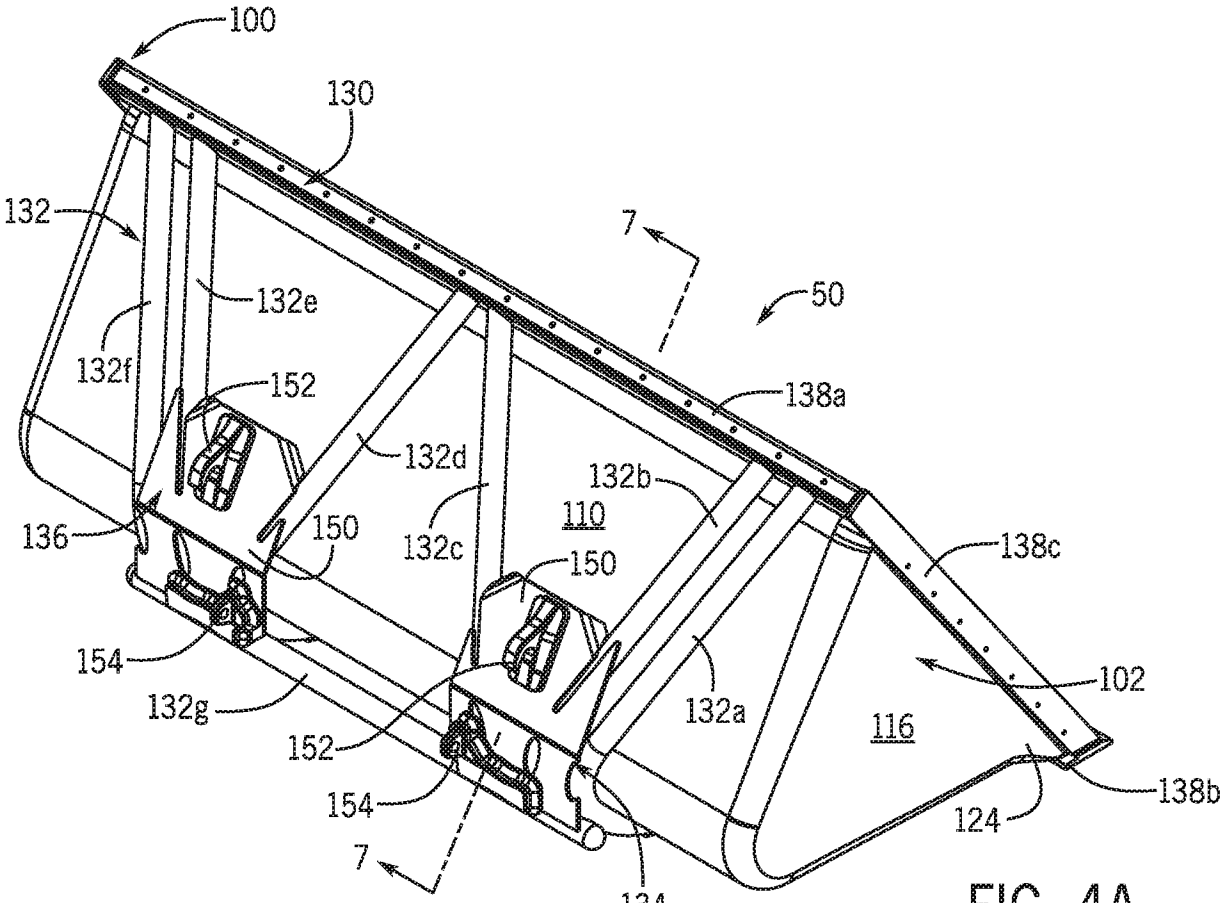
FIGS. 4A and 4B are rear perspective views of the example hybrid load bucket assembly with a bucket shell shown mounted and dismounted, respectively, to a skeletal frame.
Figure 4B:
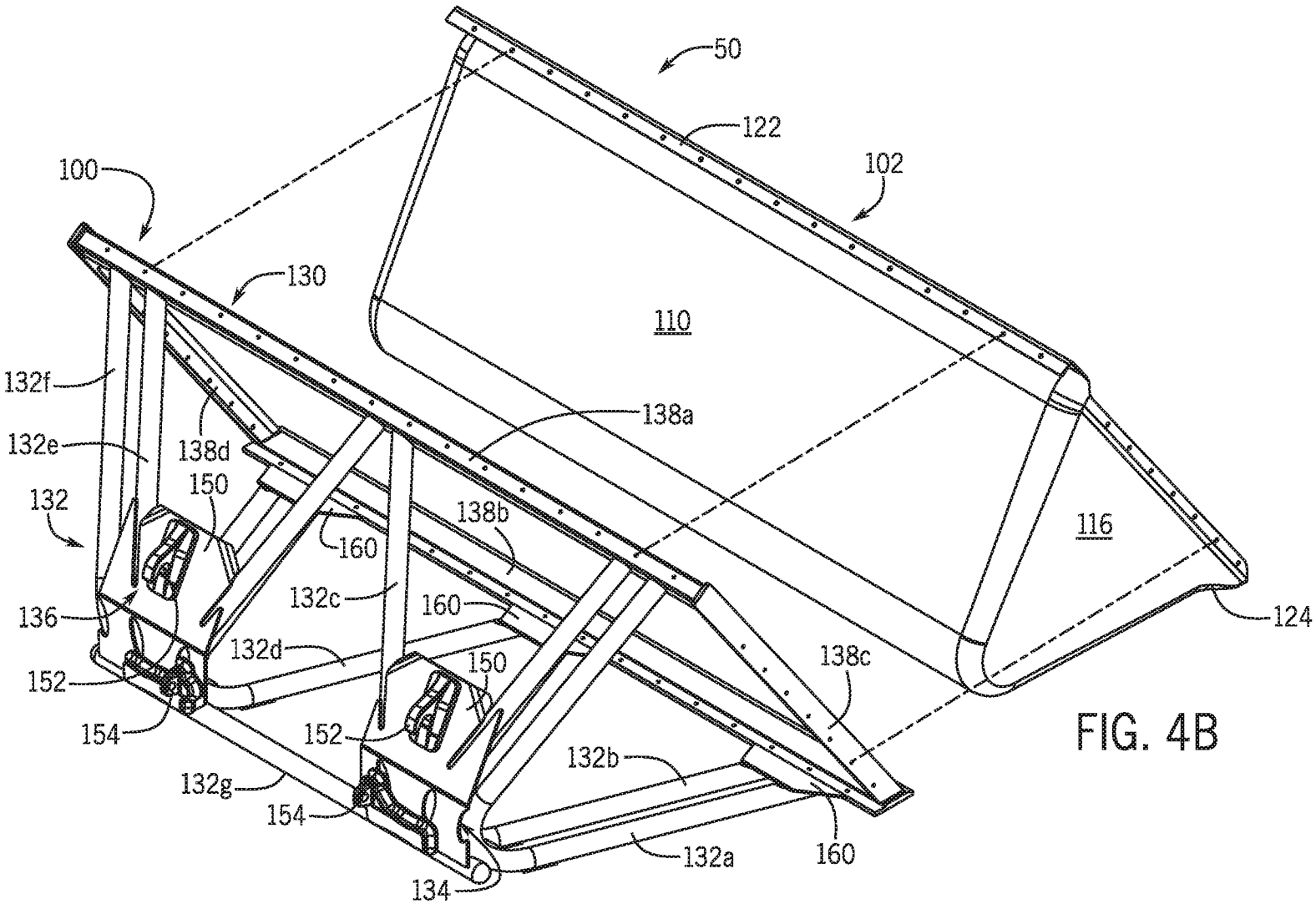
Figure 5A:
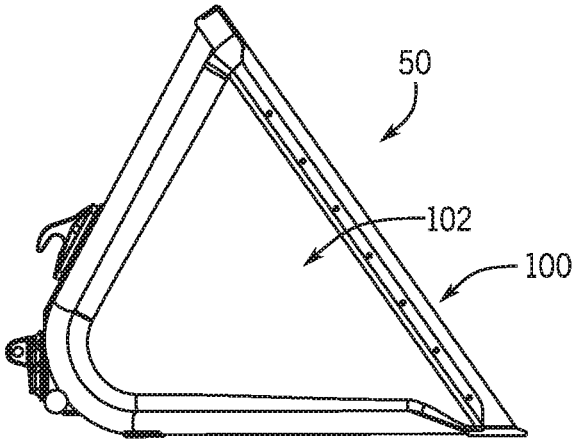
FIGS. 5A and 5B are respective side views thereof.
Figure 5B:
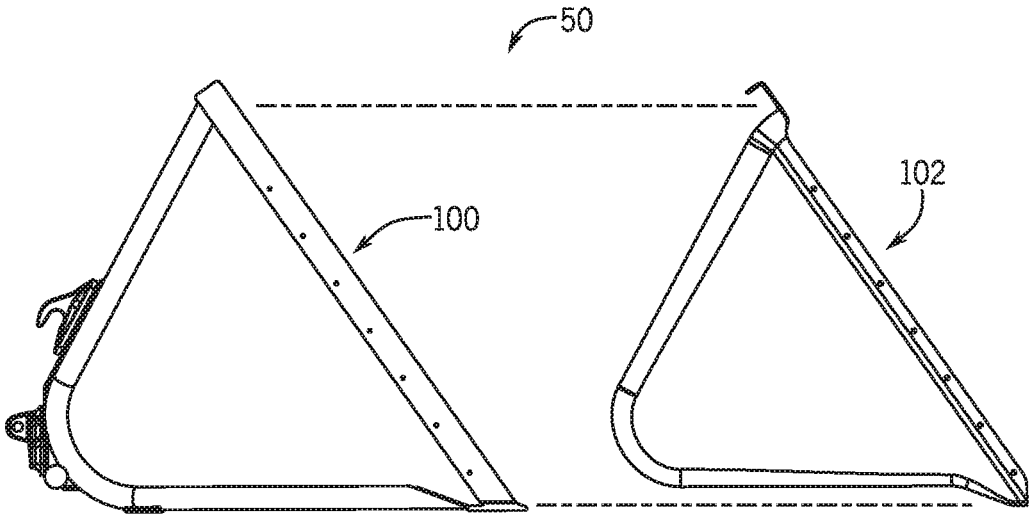
Figure 6A:
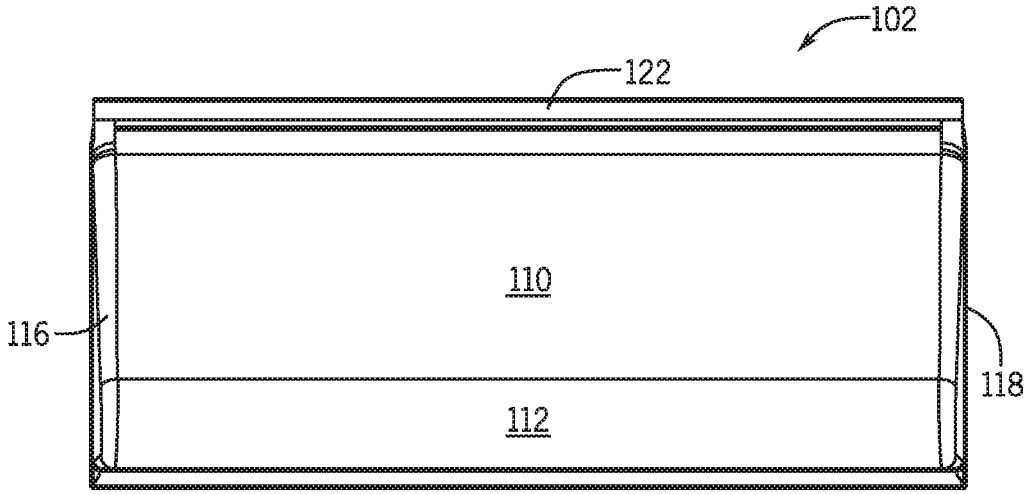
FIGS. 6A and 6B are respective front views thereof, showing the bucket shell alone in FIG. 6A and the skeleton alone in FIG. 6B.
Figure 6B:
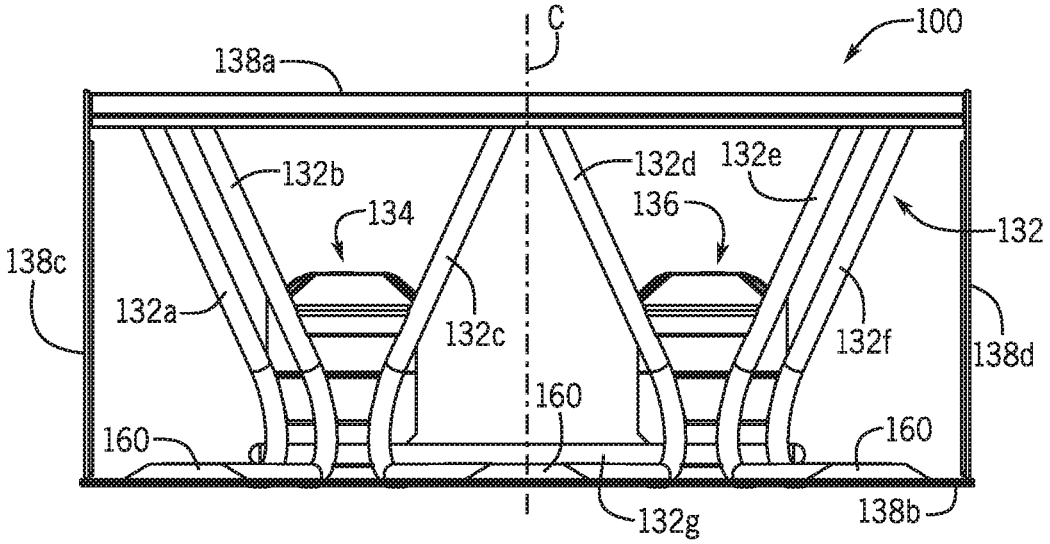

The walls of the bucket shell 102 are integrally formed and connected given their molded construction. However, they may instead be separate walls joined together by a suitable mechanical connection or bonding technique (e.g., fasteners, adhesives, ultrasonic or other welding, etc.). A front periphery 120 of the bucket shell 102 has a rectangular configuration, with, as shown in FIGS. 4B and 5B, a top edge thereof having a continuous and integral right-angle flange 122 and a bottom edge that is contoured with an inflection point at which the bucket shell 102 forms a continuous and integral downwardly extending portion 124, which angles away from the top edge out of plane with the rest of the lower wall 112. The top and bottom edge features, flange 122 and portion 124, are detailed further below.

Figure 7:
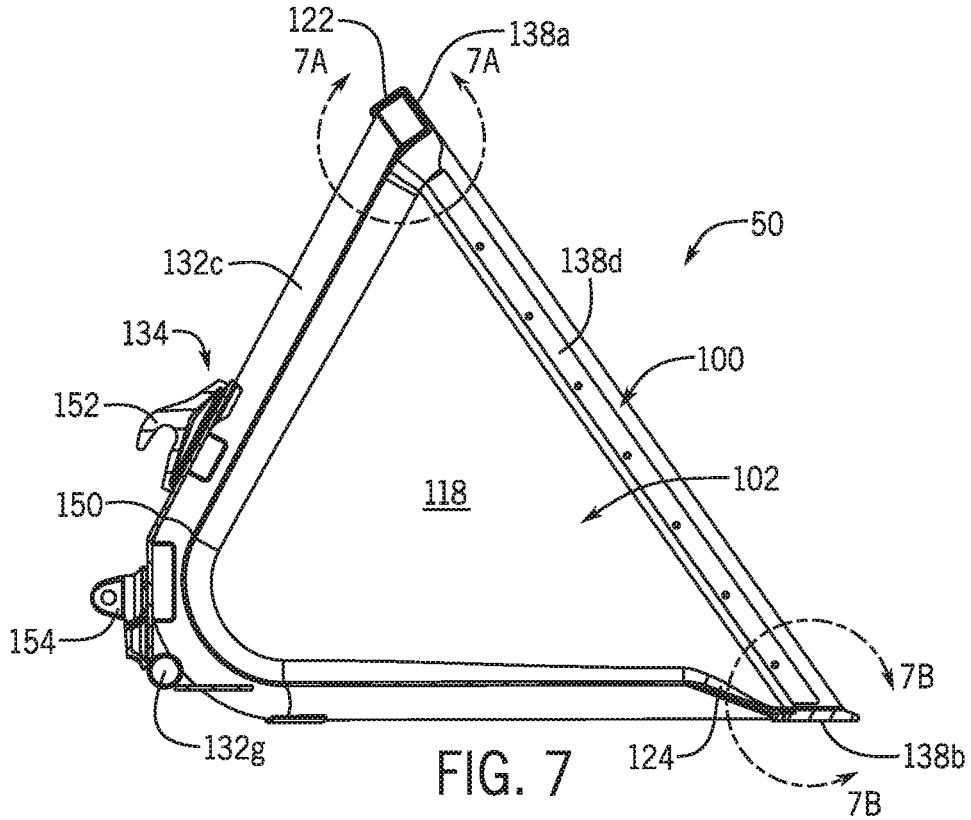
FIG. 7 is a side sectional view of the example hybrid load bucket assembly taken along line 7-7 of FIG. 4A.
Figure 7A:
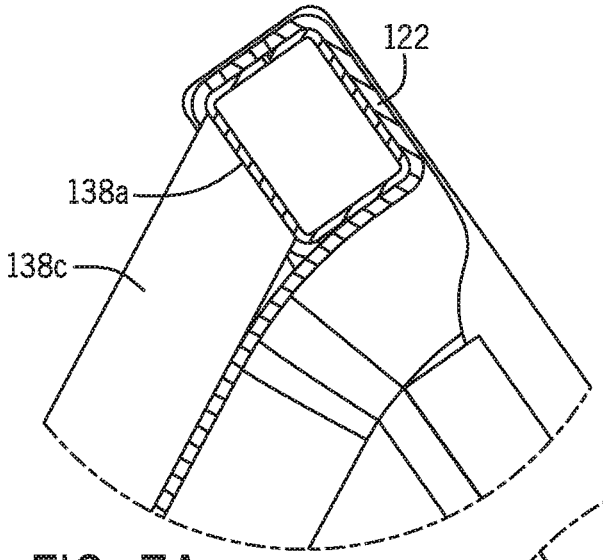
FIGS. 7A and 7B are detail views of areas 7A-7A and 7B-7B, respectively, in FIG. 7.
Figure 7B:
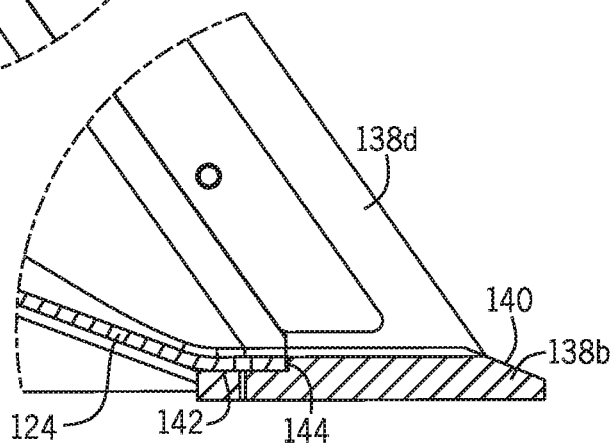

The skeleton 100 includes a frame 130, a network of trusses or support struts 132, and first and second coupling brackets 134, 136. The frame 130 is rectangular, formed as an assembly of long 138*a*, 138*b* and short 138*c*, 138*d* straight frame members. The frame 130 forms a support for the front periphery 120 of the bucket shell 102 at the leading (or cutting) edge of the HLBA 50 to maintain the shape of the bucket shell 102 (and thereby the load volume). The frame 130 may also mount to the bucket shell 102 to extend or project forward of the bucket shell 102, particularly at the lower (or cutting) edge. By recessing the bucket shell 102 into the frame 130, the HLBA 50 provides a load bucket with a leading edge that is less prone to wear, thus enhancing cutting operation of the HLBA 50 and reducing or eliminating the need to repair or replace the bucket shell 102 due to wear. As shown in FIGS. 7 and 7B, the lower frame member 138*b* is formed with a tapered cutting edge 140, to aid in cutting, and a recessed rear edge 142 defining a shoulder 144 against which the leading edge of the lower wall 112 of the bucket shell 102 may abut or for which the shoulder 144 may act as a stopping surface. The side frame members 138*c*, 138*d* also project forward of the bucket shell 102 and effectively establish side wear plates to reduce or eliminate side wall damage and wear.

In the illustrated example, the lower frame member 138*b* and frame members 138*c*, 138*d* are generally flat, straight structural members, for example, made of a suitable steel or other high-strength rigid structural material. The upper frame member 138*a* is also a straight structural member, although in the example embodiment, it has a hollow rectangular cross-section that is sized to fit within the right-angle flange 122 of the bucket shell 102. As shown in FIGS. 7 and 7A, the flange 122 wraps around the front- and upward-facing surfaces of the upper frame member 138*a*. The flange 122 may thus provide a hanger or hook feature, which may facilitate connection of the bucket shell 102 to the skeleton 100 and in positioning the bucket shell 102 prior to application of mechanical fasteners or other connection techniques.

The HLBA 50 is configured so that the bucket shell 102 is removably mounted to the skeleton 100. Removably mounting the bucket shell 102 facilitates rapid replacement of the bucket shell 102 if damaged or worn, and thus repair of the HLBA 50, while retaining the skeleton 100 (i.e., without discarding or replacing it if undamaged), and without necessarily separating the HLBA 50 from the machine (i.e., dismounting it from the loader arms 62, 64 by disconnecting it from the carrier 68). In the illustrated example, mechanical fasteners (e.g., threaded screws) spaced apart about the front periphery 120 secure the bucket shell 102 to the frame members 138*a-d* of the frame 130. Alternatively, or additionally, adhesives and other fastening techniques may be used, and similar connections may be made between the bucket shell 102 and the support struts 132.

With the frame 130, the support struts 132 form the structural backbone of the HLBA 50. The support struts 132 may be variously configured solid or hollow structural members of straight or bent configuration that are sized, shaped and positioned to support the bucket shell 102. In the illustrated example, there are six support struts 132*a-f* having a bent configuration generally in the shape of a "V." The configuration of the support struts 132*a-f* match that of the bucket shell 102 to extend along a back side of the walls 110, 112, such that they may physically contact, and thereby support, the walls 110, 112 along their entire lengths (i.e., from one end to the other each support strut). The support struts 132*a*, 132*b* are closely spaced in parallel as are the support struts 132*e*, 132*f*, which are oriented with respect to a fore-aft central reference plane "C" of the HLBA 50 (see FIG. 6B) at a generally equal and opposite angle (e.g., about 30 degrees). Support struts 132*c*, 132*d* are oriented at oblique angles with respect to the respective support struts 132*a*, 132*b* and 132*e*, 132*f*, generally being mirror images on each side of the central reference plane C. Support strut 132*g* is a straight member extending generally perpendicular to the central reference plane C and joining the other support struts 132*a-f* by a rigid connection at or near the apices of the bends therein to stabilize and rigidify the skeleton 100.

Figure 8:
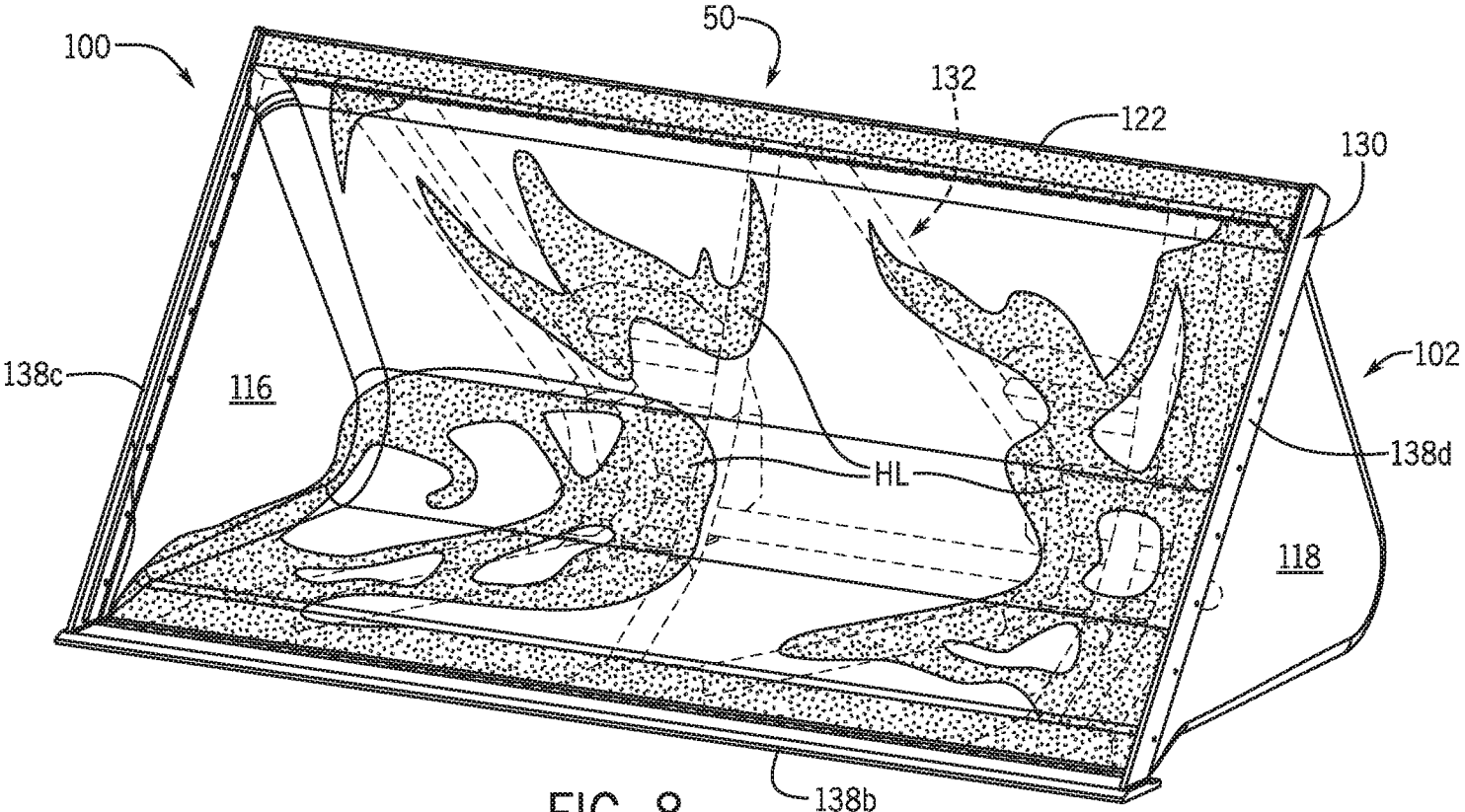
FIG. 8 is a front perspective view depicting example high load concentrations areas.

Referring also to FIG. 8, the support struts 132 may be located, oriented and configured to back the bucket shell 102 along areas of known or expected high load concentrations, for example, in the shaded or filled regions "HL" shown. When the HLBA 50 is loaded with material, such areas of relatively high load concentrations may occur within the outer one-quarter to one-third of the lateral dimension (i.e., side-to-side dimension or width) of the HLBA 50. As can be seen, the support struts 132, and especially the strut pairs (support struts 132*a*, 132*b* and 132*e*, 132*f*), are located generally along the regions HL. As mentioned previously, front peripheral support to the bucket shell 102 is provided by the frame 130. of. The network of support struts 132 and the frame 130 may be assembled in any known way providing for a rigid, structural framework, including mechanical fasteners, adhesives, welding, brazing and the like. In the illustrated example, the lower ends of the support struts 132 couple to the lower frame member 138*b* at three upstanding connection tabs 160. The upper ends of the support struts 132 connect directly to the frame member 138*a*.

The support struts 132, and thereby the skeleton 100 and the bucket shell 102, connect to the loader arms 62, 64 through connection of the coupling brackets 134, 136 to the couplers 74, 76 of the carrier 68. This connection may be releasable. In the illustrated example, the coupling brackets 134, 136 include backing plates 150 that attach to the support struts 132 and mount upper hooks 152 that open downwardly to receive from above the cross-rod 78 of the carrier 68. Lugs 154 extend rearwardly from the coupling brackets 134, 136 to align with openings in the couplers 74, 76 and receive pins that couple the skeleton 100 to the carrier 68. Removing the pins, disconnects the lugs 154, while the HLBA 50 remains mounted to the carrier 68 by engagement of the hooks 152 and the cross-rod 78. The HLBA 50 may then be separated from the loader 10 by lowering the loader arms 62, 64 relative to a stationary HLBA 50 (e.g., when resting on a platform).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A hybrid bucket assembly for a work vehicle having movable loader arms, the bucket assembly comprising:

a structural skeleton, comprising:

one or more support struts operably, fixedly coupled with one or more brackets that operably interface with a carrier at distal ends of the loader arms;

a frame comprising an upper lateral member and a lower lateral member respectively fixedly mounted to the one or more support struts; and a bucket shell selectably mounted to the structural skeleton and defining a carry volume for materials;

wherein one or more of the support struts are shell-conforming struts that have opposing ends coupled to the frame and have lengths that follow one or more outer surfaces of the bucket shell;

wherein at least one of the struts is a lateral strut that ties together the shell-conforming struts;

wherein force loading on the bucket shell is carried by the skeleton through the struts.

2. The assembly of claim 1, wherein the bucket shell is comprise of a resin material.

3. The assembly of claim 1, wherein the frame comprises at least two vertical members disposed at opposite sides of the frame, and fixedly engaged with the upper and lower lateral members.

4. The assembly of claim 1, wherein the bucket shell is selectably mounted to the frame using mechanical fasteners.

5. The assembly of claim 1, wherein the bucket shell is recessed within the frame such that at least the lower lateral member of the frame comprises a leading edge that projects beyond a lower lateral leading edge of the bucket shell.

6. The assembly of claim 5, wherein the frame has a recessed inner periphery and defines a shoulder against which abuts the lower lateral leading edge of the bucket shell.

7. The assembly of claim 1, wherein the upper lateral member of the frame is tubular; and wherein the bucket shell comprises an upper lateral flange that is operably suspended on the upper lateral member of the frame.

8. The assembly of claim 1, wherein the one or more outer surfaces of the bucket shell contact the shell-conforming struts along the lengths of the shell-conforming struts from the lower lateral member to the upper lateral member of the frame.

9. The assembly of claim 8, wherein the shell-conforming struts are spaced apart laterally with at least one shell-conforming strut in a first lateral third of the bucket, at least one bent strut in a second lateral third of the bucket, and at least one in a third lateral third of the bucket.

10. The assembly of claim 9, wherein the shell-conforming struts are arranged at one or more oblique angles with respect to a fore-aft centerline of the bucket.

11. The assembly of claim 1, wherein the brackets releasably connect to couplers of the carrier.

12. The assembly of claim 1, wherein the skeleton is made of at least one of structural steel, aluminum and carbon fiber.

13. The assembly of claim 1, wherein the bucket shell includes one or more recessed cavities that open to and augment the carry volume of the bucket shell.

14. The assembly of claim 1, wherein at least a portion of the bucket shell includes a structural reinforcement including one or more of a stiffening rib and an outer shell wall that is, at least in part, spaced apart from an inner wall of the bucket shell that defines the carry volume.

15. A work vehicle comprising:

a chassis;

loader arms movably mounted to the chassis;

a carrier mounted to distal ends of the loader arms; and a hybrid bucket assembly comprising:

a structural skeleton comprising:

one or more brackets operably mountable to the carrier;

one or more support struts operably fixedly coupled to the one or more brackets; and a frame comprising an upper lateral member the frame fixedly coupled to the one or more support struts; and a bucket shell selectably, operably mounted to the skeleton and defining a carry volume for materials;

wherein the bucket shell is recessed within the frame such that at least a lower lateral member of the frame has a leading edge that projects beyond a lower lateral leading edge of the bucket shell;

wherein the bucket shell has an upper lateral flange suspended on the upper lateral member of the frame at the upper lateral member;

wherein force loading on the bucket shell is carried by the skeleton through the struts.

16. The work vehicle of claim 15, wherein the bucket shell is a composite reinforced resin material removably mounted to the skeleton via mechanical fasteners; and wherein the skeleton is made of at least one of structural steel, aluminum and carbon fiber.

17. The assembly of claim 15, wherein some of the struts are shell-conforming struts that have opposite ends coupled to the frame and have lengths that follow one or more outer surfaces of the bucket shell;

wherein the one or more outer surfaces of the bucket shell contact the shell-conforming struts along the lengths of the shell-conforming struts from the lower lateral member to the upper lateral member of the frame;

wherein the shell-conforming struts are spaced apart laterally with at least one shell-conforming strut in a first lateral third of the bucket, at least one bent strut in a second lateral third of the bucket, and at least one in a third lateral third of the bucket; and wherein the shell-conforming struts are arranged at one or more oblique angles with respect to a fore-aft centerline of the bucket.

18. A hybrid bucket assembly kit that is selectably mountable on a carrier operably coupled to distal end of movable loader arms of a vehicle, comprising:

one or more brackets that interface with the carrier;

a plurality of support struts fixedly coupled to the one or more brackets;

a frame fixedly coupled with one or more of the plurality of support struts, the frame comprising an upper lateral member and a lower lateral member; and a bucket shell that is removably, operably mounted to the frame, the shell defining a carry volume for materials;

wherein the support struts are shell conforming to conform to the shell that have opposing ends coupled to the frame and have lengths that follow one or more outer surfaces of the bucket shell;

wherein at least one of the struts is a lateral strut that ties together the shell-conforming struts; and wherein force loading on the bucket shell is carried through the struts.

* * * * *